US005513833A

United States Patent [19]

Kirk

[11] Patent Number: 5,513,833

[45] Date of Patent: May 7, 1996

[54] STAPLE REMOVER

[76] Inventor: Norbert Kirk, 307 W. Wood Dr., Phoenix, Ariz. 85029-1853

[21] Appl. No.: 309,944

[22] Filed: Sep. 21, 1994

[51] Int. Cl.[6] ..... B25C 11/00

[52] U.S. Cl. ..... 254/28

[58] Field of Search ..... 254/28; 227/63

[56] References Cited

U.S. PATENT DOCUMENTS 3,630,486 12/1971 Foitle ..... 254/28

FOREIGN PATENT DOCUMENTS 334373 3/1989 European Pat. Off. ..... 254/28

WO91/2627 3/1991 WIPO ..... 254/28

*Primary Examiner*—Robert C. Watson

*Attorney, Agent, or Firm*—Laff, Whitesel, Conte & Saret, Ltd.

[57] ABSTRACT

A device for removing a U-shaped staple pin of the type having opposing arms driven into a surface that includes, in part, a grip portion and a lower and upper jaw pivotally mounted within said grip portion. The lower and upper jaw each include a base portion and integrally formed sides. The lower jaw cooperates with the upper jaw for movably engaging and upwardly displacing the driven staple pin from the surface. A rigid tongue member is affixed to the base and between the sides of the lower jaw. The rigid member forcibly bends the displaced staple pin substantially in half as the lower and upper jaws move the displaced staple pin into contact with the rigid member. Such forcible bending of the staple pin further causes the arms of the pin to rotate outwardly and uniformly disengage from the surface. A resilient member mounted on the base and between the sides of the upper jaw ejects the disengaged staple pin from the staple remover.

8 Claims, 4 Drawing Sheets

STAPLE REMOVER

FIELD OF THE INVENTION

This invention relates to staple removal devices. More particularly, this invention relates to a device for uniformly expanding and disengaging staple pins from stapled material without snagging the staple pin or tearing the stapled material. The same device can also be used for cutting filamentary material.

BACKGROUND OF THE INVENTION

Staple pins are used to bind various materials together, including generally thin and penetrable material such as sheets of paper. Staple pins consist of U-shaped wires including opposing arms that are forcibly driven through and inwardly clinched beneath the stapled material by a staple gun.

Staple pins are removed from stapled material by various devices. One of the most frequently used devices is a hand-held staple remover which generally includes hand grips and two pivoting jaws, each jaw with tapered claw-like projections (hereinafter referred to as "claws") on their working ends. The claws are operated in a pincer-like fashion. In use, the claws of the staple removers are positioned beneath the crown or uppermost exposed portion of the staple pin and pressure is applied to the grips. Such pressure causes the tapered claws of the jaws to move towards each other beneath the staple pin which, in turn, displaces the pin in an upward direction. As the staple pin is upwardly displaced, the staple arms bend outwardly and disengage the stapled material.

While the known staple removers provide a means to remove staple pins, there are problems associated with their use. For example, during removal one or both of the staple pin arms often remains clinched. This not only interferes with the easy removal of the staple pins but additionally may result in snagging or tearing of the stapled material. In such instances, the clinched staple pins are usually manually disengaged from the stapled material by the user's finger. This is both time consuming and potentially painful if fingernails break or fingers are pricked by the staple pins. Moreover, clinched staple pins increase the likelihood that the pins will fall onto the floor or into copiers where damage may ensue.

In addition to removal problems, disengaged staple pins frequently become caught in the staple removers. In such instances, the staple pins must again be manipulated by fingers to effectuate their removal from the staple removers. This also is time consuming and potentially injurious to the user.

Conventional staple pin removers are also generally adapted only for staple pin removal. Consequently, in a typical office or file room where string is frequently used, additional tools are required for cutting the string or other filamentary material.

Various staple remover devices have been introduced in an effort to eliminate or decrease the above-described problems. For example, U.S. Pat. No. 4,944,491 discloses a staple remover which expands a staple pin as it is removed from an object and to further retain the staple pin once it is removed from the object. This is accomplished by the inclusion of protrusions on the outer surface of each leg of the claw members of the remover. The protrusions cause the arms of the staple pin to withdraw from the stapled material and the ends of the withdrawn arms to snap into place against the inner surfaces of the claw legs. The disengaged staple pins are then manually removed by the user.

Other known staple remover devices include mechanisms for retaining disengaged staples (U.S. Pat. Nos. 3,974,999 and 4,054,263) or mechanisms for removing broken or partially removed staples (U.S. Pat. No. 4,674,272). While these, along with the above '491 patent, may, in some instances, eliminate the problems caused by the partial disengagement of staple pins from stapled material, or the problems caused by staple pins falling to the floor, they are often impractical to use or difficult to manufacture because of their complicated designs.

Accordingly, an object of the present invention is to provide a staple pin remover which uniformly and completely disengages staple pins from stapled material without snagging the staple pin or tearing the stapled material.

Another object of the present invention is to provide a staple pin remover which removes stubborn or partially disengaged staple pins.

Another object of the present invention is to provide a staple pin remover which facilitates removal of the disengaged staple pins from the remover itself.

Another object of the present invention is to provide a staple pin remover which can also cut string or other filamentary material.

Yet another object of the present invention is to provide a staple pin remover which is easier and more expeditious to use than prior devices.

SUMMARY OF THE INVENTION

The present invention, in a preferred embodiment, accomplishes the foregoing objects by providing a staple remover for removing a U-shaped staple pin with opposing arms that are forcibly driven into stapled material. The staple pin remover comprises, in part, a grip portion, a large, lower jaw, and a smaller, upper jaw. The lower and upper jaws are channel-shaped and pivotally mounted within the grip portion. The lower jaw cooperates with the upper jaw in a pincer-like manner for movably engaging and upwardly displacing a driven staple pin from the stapled material. A rigid tongue member is securely disposed between the sides of the lower jaw and forcibly bends the displaced staple pin substantially in half as the pin is moved into contact with the rigid member. This forcible bending of the staple pin further causes the arms of the pin to rotate outwardly and uniformly disengage from the stapled material. A resilient member is securely mounted at one end to the upper jaw and between the sides of the upper jaw for guiding the displaced staple pin into the rigid member and for ejecting the disengaged staple pin from the staple remover. The resilient member is hooked on its free end to provide contact with the displaced staple pin during the removal process.

The rigid tongue member is a substantially flat member which projects from the base of and in parallel relation to opposing sides of the lower jaw. The tongue includes one side which forcibly engages and bends the displaced staple pin during the removal process. The tongue includes another side with a relatively sharp edge for cutting filamentary material.

The staple pin remover also includes a series of U-shaped notches located on the sides of both claws near their pivot ends. The notches are linearly aligned so that they can all simultaneously receive particularly stubborn or partially disengaged staple pins and pry them free, if necessary.

The above, as well as other objects and advantages of the invention, will become apparent from the following detailed description of the preferred embodiment, reference being made to the accompanying drawings.

DETAILED DESCRIPTION OF THE INVENTION

Figure 1:
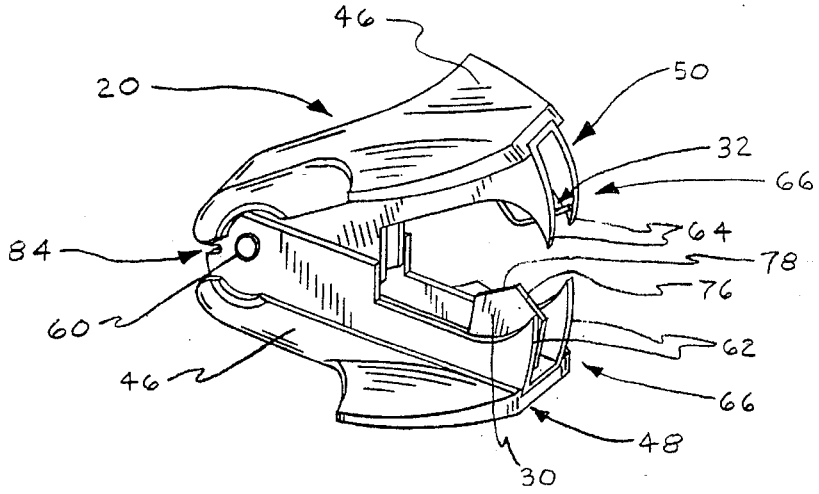
FIG. 1 is a perspective view of the inventive staple remover.

Generally referring to FIGS. 1–4, the invention provides a staple remover, denoted by the numeral 20, for removing a U-shaped staple pin 22 having opposing arms 24, 26 driven into stapled material 28. Staple pin remover 20 includes, in part, a rigid tongue member 30 for bending a staple pin substantially in half for uniformly and completely disengaging the staple pin from the stapled material.

Figure 5:
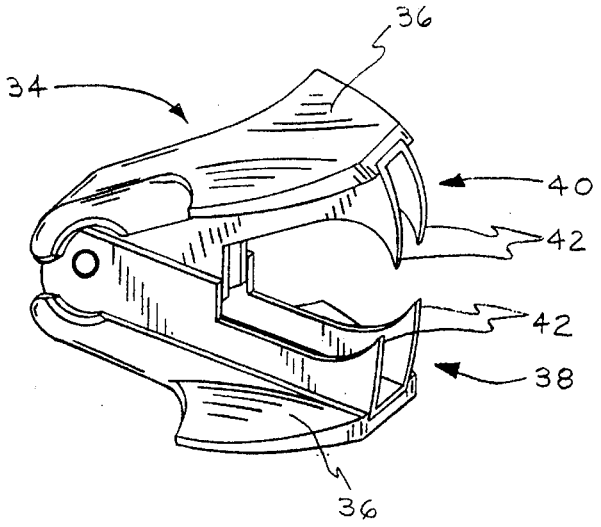
FIG. 5 (PRIOR ART)
FIG. 5 is a perspective view of a conventional staple remover.

FIG. 5 shows a conventional staple pin remover 34 which includes a hand grip portion 36 and a large, lower jaw 38 and a smaller, upper jaw 40. Two claws 42 are disposed at the working ends of each jaw and are tapered to fit beneath the crown 44 of staple pin 22 for disengaging the staple pin from the stapled material.

Figure 6:
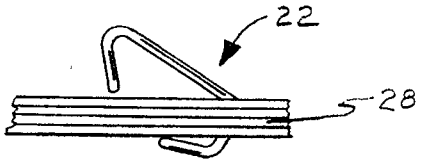
FIG. 6 (PRIOR ART)
FIG. 6 is a side view of a staple pin, illustrating its partial disengagement from stapled material with a conventional staple remover.
Figure 7:
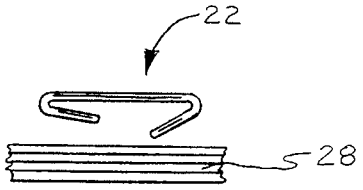
FIG. 7 (PRIOR ART)
FIG. 7 is a side view of a staple pin, illustrating its complete disengagement from stapled material with a conventional staple remover.

As shown in FIGS. 6 and 7, conventional staple pin removers are frequently troublesome because: (a) the staple pins only partially disengage from the stapled material due to a clinched arm (FIG. 6); or (b) the staple pins completely disengage from the stapled material but tear it due to two clinched arms (FIG. 7). The partially disengaged staple pins must be manually removed from the stapled material. In both instances, the clinched arms frequently snag and tear the stapled material. In addition, disengaged staple pins often become ensnared in conventional staple removers and require manual removal.

Figure 2:
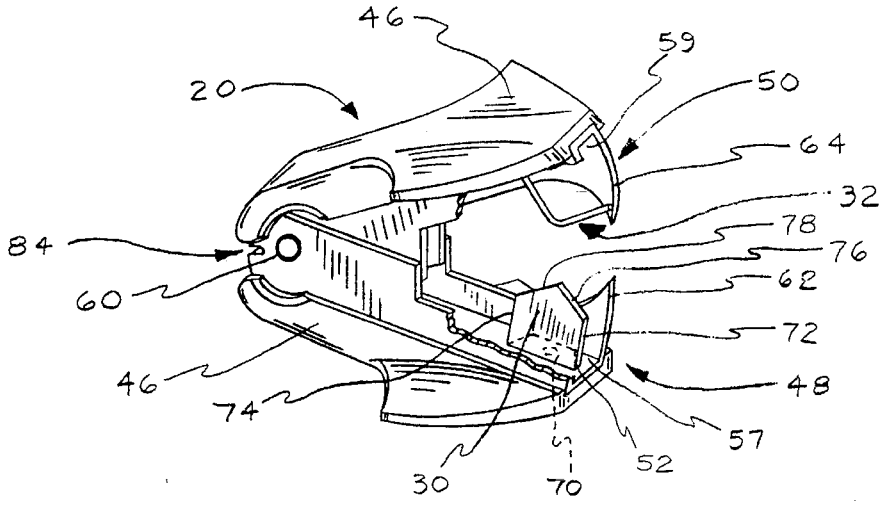
FIG. 2 is a cut-away perspective view of the staple remover of FIG. 1.
Figure 3:
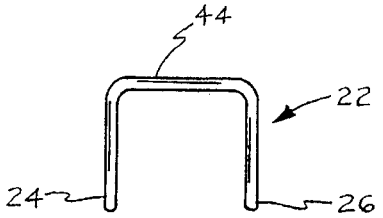
FIG. 3 is a front elevational view of a staple pin.
Figure 4:
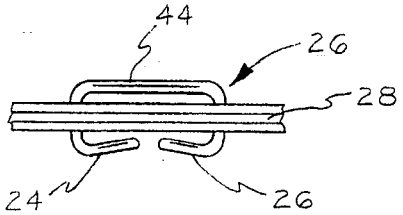
FIG. 4 is a front view of a staple pin, illustrating its appearance in stapled material.
Figure 8:
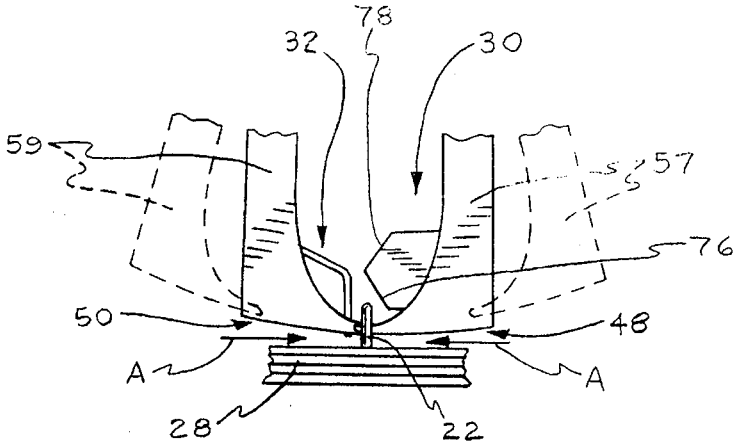
FIG. 8 is a side fragmentary view of the staple remover of FIG. 1, illustrating the pincer-like movement of the jaws beneath a driven staple pin.
Figure 9:
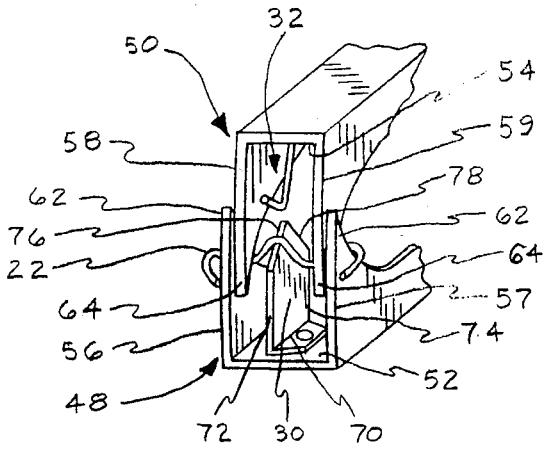
FIG. 9 is an end perspective view of the staple remover of FIG. 1, illustrating the inverted-W configuration of the staple pin subsequent to its contact with the rigid tongue member and its removal from the stapled material.

In contrast, the invention here enables the user to uniformly and completely disengage a staple pin from stapled material without snagging the staple pin or tearing the stapled material, and further facilitates removal of the disengaged staple pin from the remover itself. Referring to FIGS. 1, 2, and 8, in a preferred embodiment, staple remover 20 includes, in part, a grip portion 46, a large, lower jaw 48, and a smaller, upper jaw 50. The lower and upper jaws are channel-shaped and each includes a base portion, 52 and 54, and an integrally formed pair of parallel sides, 56, 57 and 58, 59, respectively (FIG. 9). The lower and upper jaws are within grip portion 46 and are pivotally mounted near one end by a pivot pin 60 to operate in a pincer-like manner. Tapered claws 62, 64 are disposed at the working ends 66 of the sides 56–59 and extend inwardly from the sides 56–59 of each jaw. The lower and upper jaws are closed by inward pressure on grip portion 46 and are expanded by a spring (not shown) around pivot pin 60 when the pressure is released.

Figure 10:
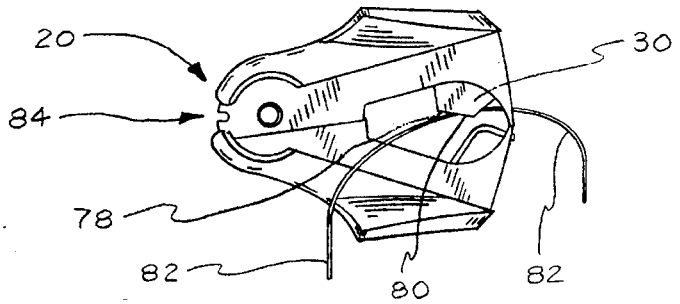
FIG. 10 is a side view of the staple remover of FIG. 1, illustrating its cutting of filamentary material.

Rigid tongue member 30 comprises a substantially flat piece of sheet metal, such as steel or rigid plastic, which is securely mounted on base portion 52 and between and in parallel relation to sides 56, 57 of the lower jaw (FIGS. 2, 9). Tongue 30 is preferably pentagonally-shaped and includes a base 70, two parallel sides 72, 74, and two adjacent angled sides 76, 78. Angled side 76 of tongue 30 closest to the claws forcibly engages and bends the upwardly displaced staple pin during the removal process (FIG. 9). Adjacent angled side 78 of tongue 30 includes a relatively sharp edge 80 for cutting filamentary material 82 (FIG. 10). The mechanics of the tongue will be described in greater detail hereinafter.

Rigid tongue member 30 is preferably attached to base portion 52 of lower jaw 48 by bending a portion of the tongue adjacent its base 70 to form a ninety degree angle (FIGS. 2, 9), but tongue member 30 could also be integrally formed with the grip portion 46 and protrude through a slot in the base portion 52. Any suitable fastening means may be used, including a one-half inch screw, to secure the bent portion of the tongue to the base 52.

Resilient member 32 is securely mounted at one end by any suitable means, such as welding, on base portion 54 and between lateral sides 58, 59 of upper jaw 50 (FIG. 9). Resilient member 32 may be a metal pin which is hooked on its free or unmounted end so that there is contact with the displaced staple pin during the removal process. The mechanics of the resilient member are also described in greater detail below.

Figure 11:
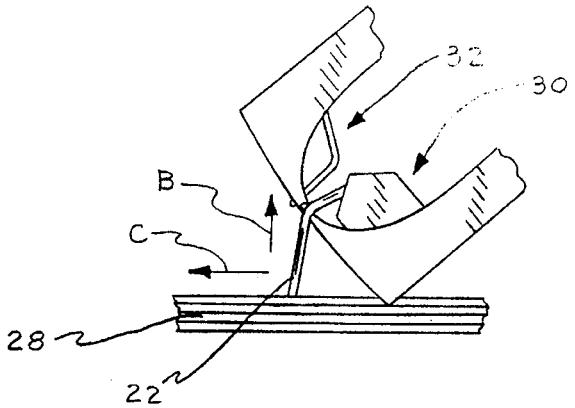
FIG. 11 is a side view of the staple remover of FIG. 1, illustrating the upward displacement and outward movement of the arms of a driven staple pin.

In use, the staple remover is positioned above a driven staple pin with claws 62 and 64 being disposed on opposite sides of the pin (FIG. 8). Once positioned, grip portion 46 is squeezed causing tapered claws 62, 64 of the lower and upper jaws to move towards each other and pass beneath crown 44 of the driven staple pin, as indicated by arrows A, A in FIG. 8. Continued pressure on grip portion 46 causes claws 62, 64 to slightly displace the staple pin in an upward direction which, in turn, results in the outward movement of the staple pin arms, as indicated by the arrows B and C in FIG. 11. As pressure is sustained, the claws (which continue to move towards each other) move the upwardly displaced staple pin into contact with angled side 76 of rigid member 30 so as to forcibly bend the displaced staple pin substantially in half (FIG. 9). This forcible bending of the staple pin against rigid member 30 further causes the arms of the pin to rotate outwardly and uniformly disengage from the stapled material. Resilient member 32 functions, in part, to guide the displaced staple pin into contact with rigid member 30 (FIG. 11).

Figure 12:
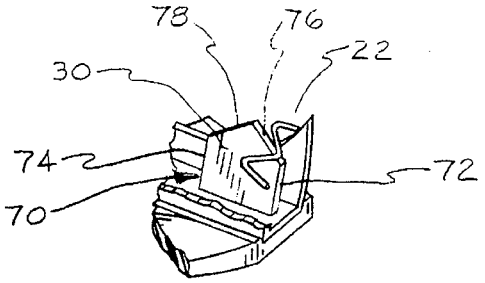
FIG. 12 is a partial cut-away view of the rigid tongue member of FIG. 1, illustrating the inverted-W configuration of the staple pin subsequent to its contact with the rigid tongue member and its removal from the stapled material.
Figure 13:
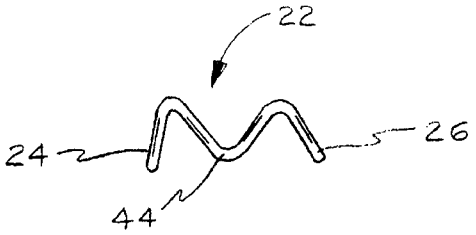
FIG. 13 is a front elevational view of the staple pin of FIG. 3, illustrating its inverted-W configuration subsequent to its removal by the inventive staple remover from the stapled material.

FIGS. 9, 12, and 13 show the inverted-W configuration of the staple pin subsequent to its contact with angled side 76 and removal from the stapled material.

The disengaged staple pin may be removed from the staple remover by first closing and then immediately expanding the upper and lower jaws. This movement creates contact between the resilient member and the staple pin which causes the pin to disengage from the staple pin remover.

Figure 14:
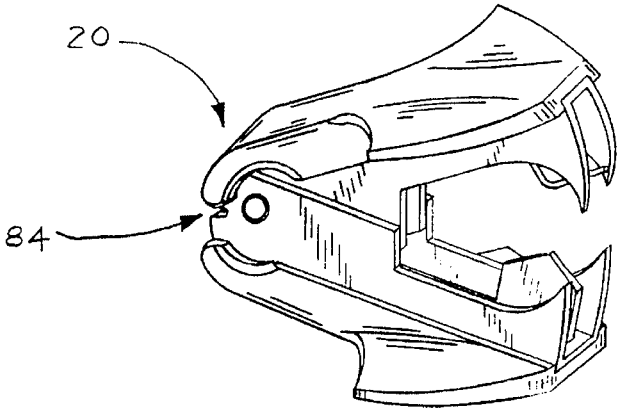
FIG. 14 is a side perspective view of the staple remover of FIG. 1, illustrating the notches disposed near its pivot end for removing stubborn or partially disengaged staple pins.

Furthermore, staple remover 20 includes a series of linearly aligned U-shaped notches 84 located on sides 56, 57 of both jaws 38, 40 near their pivot ends. Notches 84 are used to remove stubborn or partially disengaged staple pins by engaging the crown of the staple within the notches and prying it free (FIG. 14).

Staple remover 20 may additionally be used to cut filaments such as strings, rubber bands, thin wire, threads, fishing lines, plastic price tag loops, and the like. Specifically, a taut filament 82 is placed between the upper and lower jaws and then the jaws are forcibly closed which causes angled side 76 of tongue 30 to engage and lacerate the filamentary material (FIG. 10).

It should be recognized that, while the invention has been described in relation to a preferred embodiment thereof, those skilled in the art may develop a wide variation of structural details without departing from the principles of the invention. Accordingly, the appended claims are to be construed to cover all equivalents falling within the true scope and spirit of the invention.

The invention claimed is:

1. A device for removing a U-shaped staple pin comprising:

a grip portion;

a pair of jaws pivotally mounted within said grip portion, each of said jaws having a base between two spaced parallel sides defining a channel between them, each of said sides having a pivot end and a working end, said working end terminating with an inwardly projecting claw;

a rigid member mounted within one of said channels and adjacent said claws; and a resilient member mounted within the other of said channels and adjacent said claws.

2. The device of claim 1 wherein said resilient member has a hooked free end.

3. The device of claim 1 wherein said rigid member comprises a substantially flat tongue mounted in parallel relation to said sides of one of said jaws, said tongue including a base, two parallel sides, and two adjacent angled sides, and said angled sides of said tongue including an edge sharp enough for cutting filamentary material.

4. A staple remover for removing a U-shaped staple pin of the type having opposing arms driven into a surface, comprising:

a grip portion;

a pair of jaws pivotally mounted within said grip portion, said jaws each including a base portion and integrally formed opposing sides, said jaws cooperating with each other for movably engaging and upwardly displacing the driven staple pin from the surface;

a rigid member affixed to a jaw and between its sides, said rigid member forcibly bending said displaced staple pin substantially in half as said jaws move said displaced staple pin into contact with said rigid member, said forcible bending of said staple pin further causing the arms of said pin to rotate outwardly and uniformly disengage from the surface; and a resilient member affixed to the other of said jaws and between its said sides for guiding said displaced staple pin into said rigid member and for ejecting the disengaged staple pin from the staple remover.

5. The staple remover of claim 4 wherein said resilient member has a free hooked end for providing continuous contact with the displaced staple pin during its removal.

6. The staple remover of claim 4 wherein said rigid member comprises a substantially flat tongue positioned in parallel relation to opposing sides of one of said jaws.

7. The staple remover of claim 6 wherein said tongue includes a side with an edge sharp enough for cutting filamentary material.

8. The staple remover of claim 4 wherein said jaws further include at least one notch located on a side for removing stubborn or partially disengaged staple pins.

* * * * *